United States Patent [19]

Martin, Jr. et al.

[11] Patent Number: 4,541,544

[45] Date of Patent: Sep. 17, 1985

[54] VENTING CLOSURE ASSEMBLY FOR A MILK TANK

[75] Inventors: Timothy J. Martin, Jr., Lynden; Richard T. Henry, Bellingham, both of Wash.

[73] Assignee: Light Industrial Company, Lynden, Wash.

[21] Appl. No.: 656,694

[22] Filed: Oct. 1, 1984

[51] Int. Cl.[3] ..... B65D 41/10

[52] U.S. Cl. ..... 220/374; 220/373

[58] Field of Search ..... 220/373, 256, 374, 259, 220/371, 372; 55/385 C, 385 F, 385 R; 98/6, 8, 13, 19; 296/217-219

[56] References Cited

U.S. PATENT DOCUMENTS 4,081,107 3/1978 Martin, Jr. et al. ..... 220/374

4,127,216 11/1978 Martin, Jr. et al. ..... 220/374

4,315,579 2/1982 Martin, Jr. ..... 220/271

*Primary Examiner*—George T. Hall

*Attorney, Agent, or Firm*—Hughes, Barnard & Cassidy

[57] ABSTRACT

A venting closure assembly for a milk tank where there is an outside stainless steel cover and a venting closure member positioned beneath the cover. The venting closure member forms a circumferential seal around the periphery of the cover, and it has a downwardly and outwardly flaring moderately flexible skirt which forms a peripheral venting channel. When there is a surge of milk in the tank (caused by acceleration of deceleration of the tank on the road), the surge of liquid upwardly against the closure member pushes the closure member upwardly to close a vent opening in the outside cover, thus preventing milk from escaping from the outside cover.

23 Claims, 4 Drawing Figures

VENTING CLOSURE ASSEMBLY FOR A MILK TANK

BACKGROUND OF THE INVENTION

1. Field of the Invention

The present invention relates to a venting closure assembly for a containing structure, such as a milk tank.

2. Backoround Art

In the dairy industry, milk is commonly transported from dairy farms to a central processing center by means of tank trucks and trailers. The milk-containing tank itself is generally made of stainless steel and is commonly of a double-walled construction with insulation between the inner and outer stainless steel walls, so that the contained milk can be kept at an adequately low temperature while being transported.

Because of the sanitation requirements of the dairy industry, the interior of the milk tank must be thoroughly washed at regular intervals. Also, it is necessary to provide the tank with an access opening, commonly called a "manhole", to permit an inspector to actually enter the interior of the tank. Obviously, while milk is being transported, this access opening must be properly covered both to prevent milk from being spilled out of the opening, and also to prevent outside contaiminants from being mixed with the milk. There is a further requirement that the interior of the tank be vented to the outside atmosphere, since with an airtight tank even small temperature variations in the milk would cause undersired pressure differentials between the area inside the tank and the surrounding atmosphere.

A quite common means of providing the venting in a milk tank is to provide a venting member in an interior metal cover which normally closes the access opening of the tank. This venting member generally comprises a cylindrical tube mounted to the center of the cover and extending downwardly toward the interior of the tank. The interior of the tube is provided with a set of vertically spaced, staggered baffles which overlap sufficiently to define a circuitous passageway from the interior to the exterior of the tank. An annular gasket member made of a flexible material is usually placed between the perimeter portion of the cover and the support ring which defines the tank access opening, to provide a perimeter seal. Also, an exterior dust cover is positioned over the interior cover. The sanitation standards of the dairy industry require that all components which possibly come into contact with the milk be thoroughly cleaned at regular intervals.

While the prior art disclosure assembly described above has been able to perform the closing and venting functions for a milk tank in a manner to meet the standards of the dairy industry, there was a continuing need for improvement. Accordingly, there was conceived another venting closure arrangement for a milk tank, and various embodiments of this are disclosed in U.S. Pat, 4,081,107, issued March 28, 1978, and U.S. Pat. No. 4,127,216,issued Nov. 28, 1978. In general, there is described in those patents a closure assembly where there is a venting closure member having perimeter flange members which fit against a support ring of the milk tank to form a circumferential seal and one or more circumferential venting channels. There is an outer cover having a vent opening which fits over the closure member and engages the peripheral portion thereof to form the circumferential seal against the support ring. The venting channel or channels connect to circumferentially spaced openings in the flanges to provide venting from inside the tank to the area outside the tank, while preventing both spilling of the milk and contamination from outside sources.

While the assembly described in the immediately preceeding paragraph is believed to be a substantial improvement over the earlier closure assembly described above, and while this improved assembly in general has been found to function quite well in accomplishing its intended functions, it has been found that under certain circumstances, it is possible for liquid in the containing chamber to pass out through the circumferential venting channel.

Accordingly, it is an object of the present invention to provide an improved venting closure assembly for a milk tank which performs the closure function yet more reliably, while still permitting venting of the containing structure. It is yet another object to provide such a venting closure member which is able to meet the standards of sanitation and other requirements of the dairy industry.

SUMMARY OF THE INVNETION

The present invention comprises a closure assembly for a containing structure, such as a milk tank, and also a closure member particularly adapted for use in such a closure assembly. The containing structure with which the closure assembly is to be used defines a containing chamber for a liquid, and has an opening, such as a manhole, defined by a ring structure.

The assembly comprises an outside cover member having an outer perimeter portion adapted to be positioned adjacent said ring structure. The cover member has a main inner portion extending across the perimeter portion, and the inner portion has a first vent opening leading to ambient atmosphere.

There is an inside venting closure member adapted to be positioned in an operating location adjacent the cover. The closure member has an inner portion that is located below the first vent opening, and a perimeter portion surrounding the inner portion.

The closure member is characterized in that it has a relaxed position where in its operating location and without external forces applied thereto, the inner portion is spaced downwardly from the first vent opening to permit air flow through the first vent opening. The closure member further has an upwardly deflected position where, with an upper surge force exerted upon said closure member, the inner portion of the closure member is positioned against the first vent opening in closing relationship therewith.

The closure member is further characterized in that in its operating location, the closure member provides a second vent opening means spaced from the first vent opening and leading to said containing chamber to permit air flow to and from said containing chamber to an area between said cover member and said closure member.

Thus, with the venting closure member in its operating location and in its relaxed position, the containing chamber can be vented to ambient atmosphere. However, with a surge force exerted against the closure member, the closure member moves to its upwardly deflected closure position to block possible flow of liquid outwardly through said first vent opening.

Desirably, the inner portion of the closure member is contoured so that at least a portion of the upper surface thereof slopes downwardly toward said second vent opening. Thus, liquid which may pass up through said second vent opening would flow by gravity back through said second vent opening.

In the preferred configuration, the closure member has a peripheral flange portion which, with the closure member in its operating location, is positioned between the outer perimeter portion of the cover member and the ring structure so as to provide a seal between the cover and the ring structure.

The closure member, in the preferred configuration, has a passageway defining member defining a passageway that extends from said second vent opening to a third vent opening which, with the closure member in its operating location, communicates with the containing chamber. Preferably, the passageway defining member is positioned adjacent the perimeter portion of the closure member and extends at least partly along a circumferential portion of said closure member. In the preferred form, the passageway defining member extends entirely around the circumference of the closure member.

In the preferred configuration, the passageway defining member is a skirt member which extends downwardly and outwardly from the perimeter portion of the closure member. The skirt member has a lower edge portion which, with the closure member in its installed position, fits against the ring structure to define with the ring structure said passageway.

Desirably, the third vent opening is located at a position spaced circumferentially from the second vent opening means. Preferably, the third vent opening is located diametrically opposite said second vent opening means.

In one configuration, the cover member has at the location of the first vent opening a downwardly extending circumferential flange which comes into engagement with the closure member when the closure member is in its upwardly deflected position.

Other features of the present invention will become apparent from the following detailed description.

DESCRIPTION OF THE PREFERRED EMBODIMENTS

Figure 1:
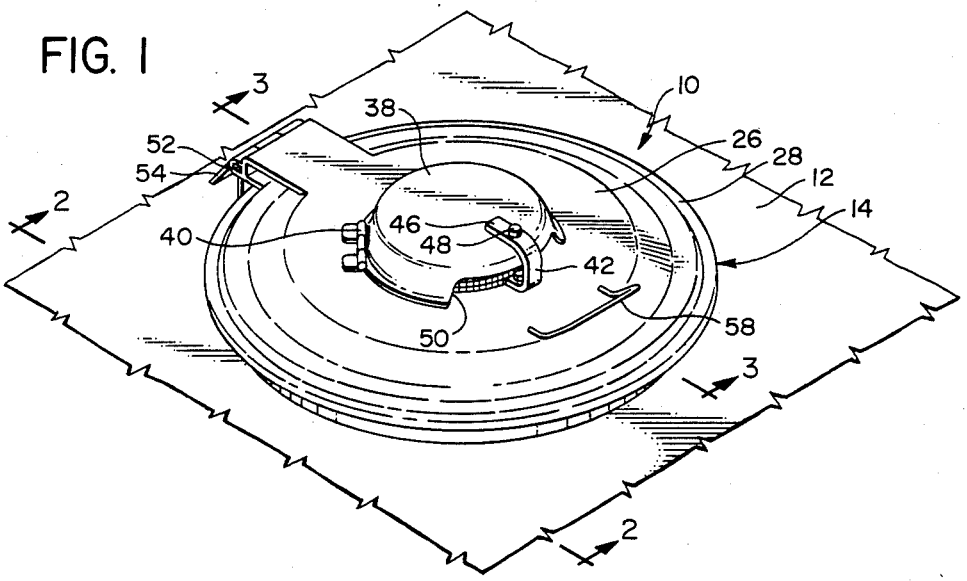
FIG. 1 is an isometric view of the venting closure assembly of the present invention, taken from a location above and to one side thereof.

The present invention is particularly adapted to meet the sanitation requirements and other requirements for closing the manhole opening of a milk tank, and thus the present invention will be described in that particular environment. However, it is to be understood that within the broader scope of the present invention, there could be application beyond the use in the dairy industry where, for example, similar problems exist, such as those described hereinafter.

The closure assembly 10 of the present invention is mounted to a platform 12 that is positioned on the top of a milk tank, a portion of which is shown at 13, and which defines a milk containing chamber 13*a*. This assembly 10 comprises an outside cover 14, made of stainless steel or the like, and a venting closure member 16 made of a moderately flexible material, such as rubber or a molded plastic having the general characteristics of a rubber-like material.

The manhole opening which is to be closed is generally designated 18, and it is defined by a perimeter ring structure 20 extending upwardly from the platform 12 and having the general configuration of a shallow upstanding cylinder. This ring structure 20 has an upper perimeter edge 22 which is moderately rounded, and an inwardly facing circumferential side surface 24.

The outside cover 14 comprises a main inner plate portion 26 which extends across a major portion of the opening 18, and a perimeter portion 28. At the center of the plate portion 26, there is a first outside venting structure 30, made as an upstanding cylindrical flange 32 formed with a plurality of through openings 34. Surrounding the cylindrical flange 32 is a porous filter material 36 which can be made of a porous woven material, an open cell plastic foam, or other material. There is a vent cover or lid 38 that is hinge mounted at 40 to the main plate portion 26 of the cover 14. This cover 38 is held in its down position by means of a flexible strap 42 bolted at 44 to the cover 14 and having a free end 46 formed with an opening to receive a closure finger 48 upstanding from the cover 38 at a location spaced from the hinge 40. The vent cover 38 is formed with an arcuate cutout or opening 50 to permit the flow of air through the venting member 30.

The main cover 14 is hinge mounted at 52 to an upstanding mounting member 54 fixedly attached to the platform 12. The level of the hinge 52 is moderately above the level of the upper edge 22 of the ring structure 20.

Figure 2:
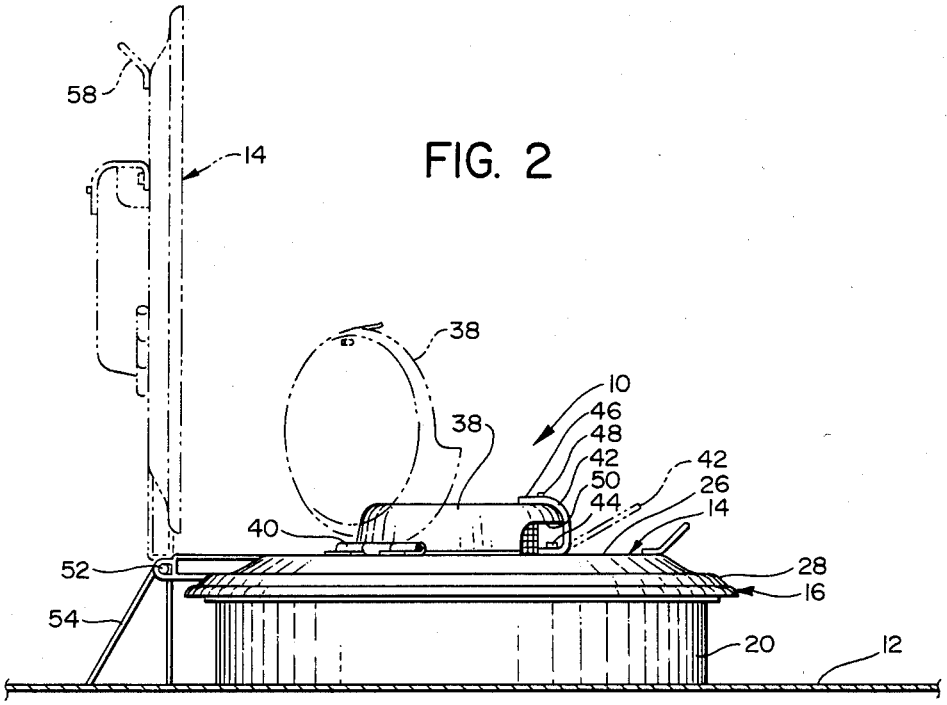
FIG. 2 is a side elevational view of the assembly of FIG. 2, showing in full lines the assembly in its closed position, and in broken lines the outer vent cover open, and the main outside cover open.

The perimeter portion 28 of the main outside cover 14 is made with a moderately down-turned lip 56 which extends radially just beyond the upper edge 22 of the ring structure 20. Also, the cover 14 has a handle 58 by which the cover 14 can be moved to its upper opened position, as shown in the broken lines of FIG. 2.

Figure 3:
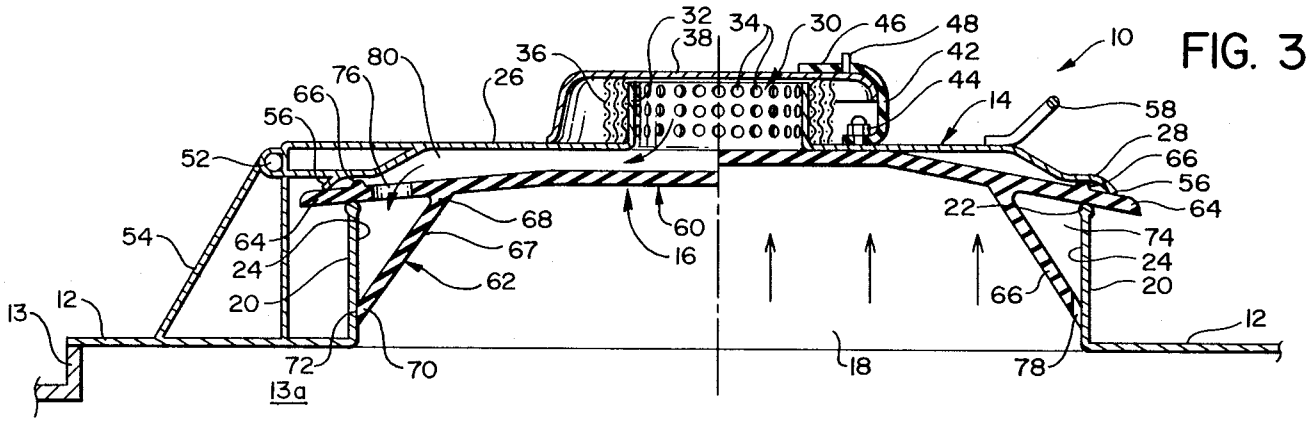
FIG. 3 is a sectional view taken along line 3—3 of FIG. 1, with the lefthand portion of FIG. 3 illustrating an inner closure member of the present invention in its relaxed position, and with the right hand portion of FIG. 3 showing the closure member in its upwardly deflected position where it closes the vent opening of the outside cover.

The aforementioned venting closure member 16 has a main inner plate portion 60, and a perimeter portion 62. The perimeter portion 62 comprises a laterally extending perimeter flange 64 which can be made as a circumferential radially outward extension of the main plate member 60. When the closure member 16 is in its operating location (as shown in FIG. 3), the perimeter flange 64 extends a short distance beyond the upper edge 22 of the ring structure 20. Thus, with the outer cover 14 in its closed position, the perimeter portion 28 of the outer cover 14 presses against the flange 64 of the closure member 60 to form a peripheral seal around the edge 22 of the ring structure 20. The perimeter flange 64 has an upstanding annular lip or bead 66 positioned at the location of the upper edge 22 of the ring structure 20 to improve the sealing function of the perimeter flange 64.

The perimeter portion 62 also comprises a downwardly and outwardly extending, moderately flexible skirt 66, having a generally frusto-conical configuration. The upper edge 68 of the skirt 66 connects to the perimeter portion of the main plate portion 60, and is spaced radially inwardly from the location of the edge 22 of the ring structure 20 a moderate distance. The lower edge 70 of the skirt 66 has a radially outwardly extending contact surface 72 that fits against a lower portion of the inner surface 24. Thus, with the closure member 16 in its installed or operating position, as illustrated in FIG. 3, the skirt 66 forms with the ring structure 20 and with the radially inward portion of the flange 64 a circumferential venting passageway 74.

The flange 64 is formed with a through opening 76 at a location just radially outward of the skirt upper edge 68 and radially inward of the edge 22 of the ring structure 20. At a location diametrically opposite the location of the vent opening 76, there is a second vent opening 78 formed as a cutout or recess in the lower edge portion 70 of the skirt 66. Thus, the opening 78 is defined on one side by the adjacent surface 24 of the ring structure 20 and the portion of the skirt 66 at the location of the cutout.

Thus, it can be seen that the containing chamber 13 vents to ambient atmosphere through the opening 78, through the circumferential passageway 74, through the second vent opening 76, thence through a flow area 80 positioned between the main cover portion 26 and the main plate portion 60 of the closure member 16, and thence through the cover vent structure 30. Further, the closure member 16 is formed so that in its unstressed or relaxed position (i.e. its position when no external forces are applied thereto, except for the force of gravity), the outer portion **60*a* of the main plate portion 60 has outwardly of the location of the cover vent 30 a very slight upward and radially inward slope. The central portion 60*b* of the main plate portion 60 of the closure member 16** is positioned substantially horizontal.

With the closure member 16 in its installed or operating position, as shown in FIG. 3, the central portion **60*b* of the plate member 60 of the closure member 16 is positioned a moderate distance below the lower edge of the venting cylinder 32 of the outside vent structure 30. The perimeter flange 56 of the closure member 16 is pressed with a moderate force by the perimeter portion 28 of the cover member 14 downwardly against the upper edge 22 of the ring structure 20 so as to form a peripheral seal. Thus, the only open path of communication is the aforementioned venting path, comprising the opening 28, the vent passageway 74, the opening 76, the flow area 80, and the holes 34 in the vent member 32**.

To describe the operation of the present invention, the cover 14 generally remains attached by the hinge mounting 52 at all times to the mounting structure 54 that is in turn mounted to the plate 12. On the other hand, the closure member 16 can easily be removed from the ring structure 16 for periodic washing and be replaced in its installed position as shown in FIG. 3. The outer cover 14 can be provided with a suitable clamping device to hold it securely in its closed position of FIG. 3. For convenience of illustration, such a clamping device is not shown herein, but it is or may be of conventional design.

With the closure member 16 installed as shown in FIG. 3, and with the outside cover 14 closed, the main plate member 60 will normally be in its relaxed position, as shown in the lefthand side of FIG. 3, so that the containing chamber 13 vents to the outside, as described above. Thus, if there is a change of temperature in the containing structure, so that air in the chamber 13 either expands or contracts, the containing structure **13*a* will not be stressed, because of the pressure equalization provided by the venting path, as described above. Further, with the arrangement of the outer venting structure 30, contaminents from outside will be prevented from passing through the filter material 36 and through the wall or flange 32**.

With the containing structure 13 being a milk tank which is being moved by a vehicle along a highway, as the vehicle accelerates, and especially as the truck rapidly decelerates (such as during a strong application of the vehicle's brakes), the milk in the tank will tend to surge toward one end of the tank, so as to apply liquid pressure against a major portion of the upper surface of the tank. When the upward surge of liquid reaches the plate member 60, it pushes the central plate portion **60*b* of the closure member 16 upwardly against the lower edge of the cylindrical vent wall 32, closing off the venting structure 30 from communication with the tank interior 13*a*. A portion of the liquid or milk that surges may pass up the inner vent opening 78 and begin to flow through the venting passageway 74. Even if the surge is of sufficient duration and strength so that liquid passes through the vent passageway 74 and out vent passageway 76, the milk or other liquid is blocked from passing into the venting structure 30 by reason of the center plate portion 60*b* closing off the vent structure 30. When the surge subsides, the milk or other liquid flows by gravity flow back outwardly through the vent opening 78**.

Further, with the skirt 66 being arranged in an outwardly and downwardly depending pattern, the surge of milk tends to force the skirt 66 in an upward and radially outward direction so as to improve the seal function of the skirt 66 against the ring structure 20.

Thus, it can be appreciated that the closure member 16 serves a number of functions. First, it functions as a gasket or seal to close the peripheral area at the location of the ring upper edge 20 and the peripheral portion 28 of the outer cover 14. Second, the closure member 16 performs a general closure function in that it provides an inner closure or cover in addition to the outer cover 14. Third, the closure member 16 provides a venting passageway, in the form of the opening 78, passageway 74, opening 76, flow area 80, and venting member 30. Fourth, the closure member 16 provides a temporary total closure of the vent path in a surge condition, by reason of the middle plate portion **60*b* moving upwardly by reason of the force of the surge to close off the vent structure 30. Fifth, in the event that any milk or other liquid does flow upwardly, possibly into the vent passageway 74 or even upwardly through the vent opening 76, there is a path for flow back into the containing chamber 30**.

The closure member 16 can be formed as one integral molded part. Further, it can be readily appreciated that the closure member 16 can easily be removed for washing.

Figure 4:
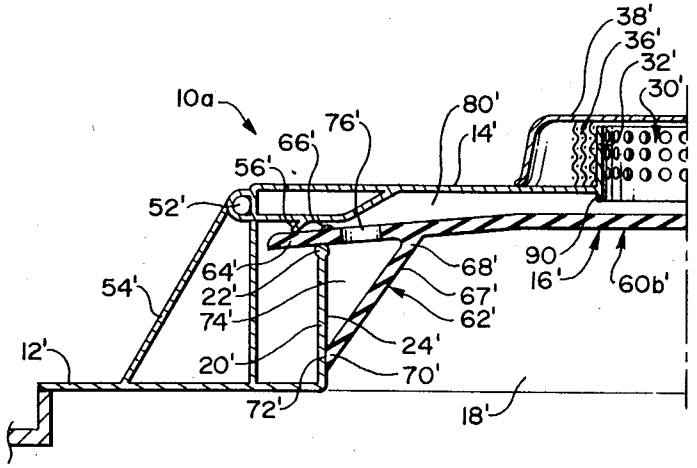
FIG. 4 shows a modified arrangement of the outside cover member illustrated in FIGS. 1–3.

A modified version of the closure assembly is illustrated in FIG. 3. For convenience of illustration, only one-half of the modified closure member **10*a* is illustrated in FIG. 4. Also, components which are substantially the same as in the first embodiment of FIGS. 1–3 will be given like numerical designations with a prime (′) designation distinguishing those of the second embodiment. Thus, there is a portion or flange 64′, a skirt 66′, and a vent opening 76′**.

The cylindrical venting wall 32' is formed with a downwardly extending annular lip or flange 90, which is positioned a moderate distance above the center plate portion 60b' of the closure member 16'. Thus, when there is a surge of liquid which forces the center plate portion 60b' upwardly, this plate portion 60b' will come into contact with this peripheral lip 90 with a relatively greater localized pressure so as to form a more secure closure for the venting structure 30'.

As another possible modification, a filtration material can be placed in the venting passageway 74.

It is apparent that various modifications could be made to the assembly as described herein without departing from the basic teachings of the present invention.

We claim

1. A closure assembly for a containing structure, such as a milk tank, which containing structure defines a containing chamber for a liquid, and which has an opening, such as a manhole, defined by a ring structure, said assembly comprising:

a. an outside cover member having an outer perimeter portion adapted to be positioned adjacent said ring structure, and also having a main inner portion extending across said perimeter portion, said inner portion having a first vent opening leading to ambient atmosphere;

b. an inside venting closure member adapted to be positioned in an operating location adjacent said cover, said closure member having an inner portion that is located below the first vent opening and a perimeter portion surrounding said inner portion;

c. said closure member being characterized in that it has a relaxed position where in its operating location and without external forces applied thereto, the inner portion is spaced downwardly from said first vent opening to permit air flow through said first vent opening, said closure member having an upwardly deflected position where, with an upper surge force exerted upon said closure member, the inner portion of the closure member is positioned against said first vent opening in closing relationship therewith;

d. said closure member being further characterized in that in its operating location the closure member provides a second vent opening means spaced from said first vent opening and leading to said containing chamber to permit air flow to and from said containing chamber to an area between said cover member and said closure member; whereby with the venting closure member in its operating location and in its relaxed position, said containing chamber can be vented to ambient atmosphere, and with a surge force exerted against said closure member, said closure member moves to its upwardly deflected closure position to block possible flow of liquid outwardly through said first vent opening.

2. The assembly as recited in claim 1, wherein the inner portion of the closure member is contoured so that at least a portion of an upper surface thereof slopes downwardly toward said second vent opening, whereby liquid which may pass up through said second vent opening would flow by gravity back through said second vent opening.

3. The assembly as recited in claim 1, wherein said closure member has a peripheral flange portion which, with the closure member in its operating location, is positioned between the outer perimeter portion of the cover member and said ring structure so as to provide a seal between said cover and said ring structure.

4. The assembly as recited in claim 3, wherein said closure member has a passageway defining member defining a passageway that extends from said second vent opening means to a third vent opening which, with the closure member in its operating location, communicates with said containing chamber.

5. The assembly as recited in claim 4, wherein said passageway defining member is positioned adjacent the perimeter portion of the closure member and extends at least partly along a circumferential portion of said closure member.

6. The assembly as recited in claim 5, wherein said passageway defining member extends entirely around the circumference of the closure member.

7. The assembly as recited in claim 6, wherein said passageway defining member is a skirt member which extends downwardly and outwardly from the perimeter portion of the closure member, said skirt member having a lower edge portion which, with the closure member in its installed position, fits against the ring structure, to define with the ring structure said passageway.

8. The assembly as recited in claim 7, wherein said skirt member is formed with said third vent opening at a location spaced circumferentially from said second vent opening means.

9. The assembly as recited in claim 8, wherein said third vent opening is located diametrically opposite said second vent opening means.

10. The assembly as recited in claim 1, wherein said outside cover member has a downwardly extending peripheral flange surrounding said first vent opening, whereby, with the venting closure member in its upwardly deflected position, the inner portion of the closure member forms a closure with the flange of the cover member.

11. The assembly as recited in claim 1, wherein said closure member has a peripheral flange member which, with the closure member in its operating location, is positioned between the outer perimeter portion of the cover member and said ring structure so as to provide a seal between said cover and said ring structure, said closure member having at its perimeter portion a downwardly and outwardly extending moderately flexible skirt portion which, with the venting closure member in its operating location, is positioned against said ring structure, said skirt portion defining with said ring structure a circumferential venting passageway extending around said closure member.

12. The assembly as recited in claim 11, wherein there is a third vent opening formed in said skirt member, and said third vent opening is circumferentially spaced from said second vent opening means.

13. A venting closure member adapted to be used for a containing structure, such as a milk tank, which containing structure defines a containing chamber for a liquid, which has an opening, such as a manhole, defined by a ring structure, and which has an outside cover member having an outer perimeter portion adapted to be positioned adjacent said ring structure, and also having a main inner portion extending across said perimeter portion, said inner portion having a first vent opening leading to ambient atmosphere, said venting closure member adapted to be positioned in an operating location adjacent said cover, said closure member having an inner portion that is located below the first vent opening and a perimeter portion surrounding said inner portion, said closure member being characterized in that it has a relaxed position where in its operating location and without external forces applied thereto, the inner portion is spaced downwardly from said first vent opening of the cover member to permit air flow through said first vent opening, said closure member having an upwardly deflected position where, with an upper surge force exerted upon said closure member, the inner portion of the closure member is positioned against said first vent opening in closing relationship therewith, said closure member being further characterized in that in its operating location the closure member provides a second vent opening means spaced from said first vent opening and leading to said containing chamber to permit air flow to and from said containing chamber to an area between said cover member and said closure member; whereby with the venting closure member in its operating location and in its relaxed position, said containing chamber can be vented to ambient atmosphere, and with a surge force exerted against said closure member, said closure member moves to its upwardly deflected closure position to block possible flow of liquid outwardly through said first vent opening.

14. The venting closure member as recited in claim 13, wherein the inner portion of the closure member is contoured so that at least a portion of an upper surface thereof slopes downwardly toward said second vent opening, whereby liquid which may pass up through said second vent opening would flow by gravity back through said second vent opening.

15. The venting closure member as recited in claim 13, wherein said closure member has a peripheral flange portion which, with the closure member in its operating location, is positioned between the outer perimeter portion of the cover member and said ring structure so as to provide a seal between said cover and said ring structure.

16. The venting closure member as recited in claim 15, wherein said closure member has a passageway defining member defining a passageway that extends from said second vent opening means to a third vent opening which, with the closure member in its operating location, communicates with said containing chamber.

17. The venting closure member as recited in claim 16, wherein said passageway defining member is positioned adjacent the perimeter portion of the closure member and extends at least partly along a circumferential portion of said closure member.

18. The venting closure member as recited in claim 17, wherein said passageway defining member extends entirely around the circumference of the closure member.

19. The venting closure member as recited in claim 18, wherein said passageway defining member is a skirt member which extends downwardly and outwardly from the perimeter portion of the closure member, said skirt member having a lower edge portion which, with the closure member in its installed position, fits against the ring structure, to define with the ring structure said passageway.

20. The venting closure member as recited in claim 19, wherein said skirt member is formed with said third vent opening at a location spaced circumferentially from said second vent opening means.

21. The venting closure member as recited in claim 20, wherein said third vent opening is located diametrically opposite said second vent opening means.

22. The venting closure member as recited in claim 13, wherein said closure member has a peripheral flange member which, with the closure member in its operating location, is positioned between the outer perimeter portion of the cover member and said ring structure so as to provide a seal between said cover and said ring structure, said closure member having at its perimeter portion a downwardly and outwardly extending moderately flexible skirt portion which, with the venting closure member in its operating location, is positioned against said ring structure, said skirt portion defining with said ring structure a circumferential venting passageway extending around said closure member.

23. The venting closure member as recited in claim 22, wherein there is a third vent opening formed in said skirt member, and said third vent opening is circumferentially spaced from said second vent opening means.

* * * * *